US011142419B2

(12) United States Patent
Osborne, Jr.

(10) Patent No.: US 11,142,419 B2
(45) Date of Patent: Oct. 12, 2021

(54) DISPENSING ASSEMBLY FOR SELECTIVELY DISPENSING A PLURALITY OF SUPPLIES OF ROLLED SHEET MATERIAL

(71) Applicant: Charles Agnew Osborne, Jr., Cumming, GA (US)

(72) Inventor: Charles Agnew Osborne, Jr., Cumming, GA (US)

( * ) Notice: Subject to any disclaimer, the term of this patent is extended or adjusted under 35 U.S.C. 154(b) by 126 days.

(21) Appl. No.: 16/709,265

(22) Filed: Dec. 10, 2019

(65) Prior Publication Data

US 2020/0189869 A1 Jun. 18, 2020

Related U.S. Application Data

(60) Provisional application No. 62/778,570, filed on Dec. 12, 2018.

(51) Int. Cl.
*B65H 16/02* (2006.01)
*B65H 16/00* (2006.01)

(52) U.S. Cl.
CPC ..... *B65H 16/021* (2013.01); *B65H 16/005* (2013.01)

(58) Field of Classification Search
None
See application file for complete search history.

(56) References Cited

U.S. PATENT DOCUMENTS 2,299,301 A 10/1942 Britt et al.
2,549,912 A 4/1951 Lindsay
2,840,319 A 6/1958 Danko
3,007,650 A 11/1961 Burton
3,010,670 A 11/1961 Jones et al.
3,387,902 A 6/1968 Perrin et al.
(Continued)

FOREIGN PATENT DOCUMENTS

EP 0452577 A1 10/1991
EP 1033100 A2 9/2000
(Continued)

OTHER PUBLICATIONS

International Search Report and the Written Opinion of the International Search Authority for PCT/US2019/065460, dated Apr. 6, 2020.

*Primary Examiner* — William A. Rivera
(74) *Attorney, Agent, or Firm* — Womble Bond Dickinson (US) LLP

(57) ABSTRACT

In one aspect, the present disclosure is directed to a dispenser assembly for dispensing supplies of sheet material. The dispensing assembly can include a carrier supporting the supplies of sheet material and being moveable along a track between various dispensing positions. The dispenser assembly also can include a carrier pivoting assembly with a lever that engages one of the supplies of sheet material and rotates during dispensing thereof, as well as one or more biased pins connected to the lever and configured to engage locking features provided along the track to support the carrier in one of the dispensing positions. The biased pins further can be configured to retract with rotation of the lever such that they disengage the locking features so the carrier to moves along the track to different dispensing position. Other aspects also are described.

14 Claims, 11 Drawing Sheets

(56) References Cited

U.S. PATENT DOCUMENTS 3,572,600 A 3/1971 Jespersen
3,637,276 A 1/1972 Bump
3,650,487 A 3/1972 Bahnsen
3,677,485 A 7/1972 Berg
3,690,580 A 9/1972 Jesperson
3,698,653 A 10/1972 Okamura
3,700,181 A 10/1972 Diring et al.
3,754,719 A 8/1973 Choy
3,770,222 A 11/1973 Jespersen
3,771,739 A 11/1973 Nelson
3,865,295 A 2/1975 Okamura
3,948,454 A 4/1976 Bastian
4,108,389 A 8/1978 Womack
4,113,195 A 9/1978 Theunissen
4,143,827 A 3/1979 Tucker
4,165,138 A 8/1979 Hedge et al.
4,260,117 A 4/1981 Perrin et al.
4,285,474 A 8/1981 Perez
4,307,638 A 12/1981 DeLuca et al.
4,340,195 A 7/1982 DeLuca
4,363,454 A 12/1982 Mohar
4,375,874 A 3/1983 Leotta et al.
4,422,584 A 12/1983 Dashnier et al.
4,422,585 A 12/1983 Schultz et al.
4,487,375 A 12/1984 Rasmussen et al.
4,520,968 A 6/1985 Shpigelman
4,552,315 A 11/1985 Granger
4,564,148 A 1/1986 Wentworth
4,634,192 A * 1/1987 Fielding ..... A47K 10/28 312/34.22
4,765,475 A 8/1988 Kaysserian
4,796,832 A 1/1989 Schutz et al.
4,807,823 A 2/1989 Wyant
4,830,301 A 5/1989 Miller
4,836,462 A 6/1989 Bruss
4,872,601 A 10/1989 Sigmund
4,879,150 A 11/1989 Schutz et al.
4,944,466 A 7/1990 Jespersen
5,000,393 A 3/1991 Madsen
5,009,313 A 4/1991 Morand
5,265,816 A 11/1993 Collins
5,271,574 A 12/1993 Formon et al.
5,288,032 A 2/1994 Boone et al.
5,314,131 A 5/1994 McCanless et al.
5,370,336 A 12/1994 Whittington
5,400,982 A 3/1995 Collins
5,449,127 A 9/1995 Davis
5,558,302 A 9/1996 Jesperson
5,628,474 A 5/1997 Krueger et al.
5,636,812 A 6/1997 Conner et al.
5,645,244 A 7/1997 Moody
5,669,576 A 9/1997 Moody
5,690,299 A 11/1997 Perrin et al.
5,749,538 A 5/1998 Brown et al.
5,813,624 A 9/1998 Grasso et al.
5,868,335 A 2/1999 Lebrun
5,873,542 A 2/1999 Perrin et al.
5,954,256 A 9/1999 Niada
6,027,002 A 2/2000 Granger
6,082,664 A 7/2000 Phelps et al.
6,092,759 A 7/2000 Gemmell et al.
6,138,939 A 10/2000 Phelps et al.
6,152,397 A 11/2000 Purcell
6,189,828 B1 2/2001 Reilly
6,202,956 B1 3/2001 Grasso et al.
6,290,169 B1 9/2001 Hartley
6,315,237 B1 11/2001 Hoerner
6,328,255 B1 12/2001 Moody et al.
6,364,245 B1 4/2002 Paal et al.
6,382,553 B1 5/2002 Lewis et al.
6,405,972 B1 6/2002 Wakam
6,409,120 B1 6/2002 Tramontina et al.
6,422,503 B1 7/2002 Kong
6,491,251 B1 12/2002 Stanland et al.
6,520,372 B2 2/2003 Phelps
6,527,219 B1 3/2003 Trecartin
6,550,714 B1 4/2003 Granger
6,561,378 B1 5/2003 Roessler et al.
6,607,160 B2 8/2003 Lewis et al.
6,648,267 B2 11/2003 Stanland et al.
6,679,409 B2 1/2004 Petterson
6,702,225 B2 3/2004 Newman et al.
6,715,637 B1 4/2004 Ramos
6,736,348 B1 5/2004 Formon et al.
6,736,466 B1 5/2004 Helland et al.
6,752,349 B2 6/2004 Moody et al.
6,758,434 B2 7/2004 Kapiloff et al.
6,786,448 B2 9/2004 Arcilesi
6,826,991 B1 12/2004 Rasmussen
6,830,210 B2 12/2004 Formon et al.
6,902,134 B2 6/2005 Green et al.
6,915,935 B2 7/2005 Portnoy
6,920,999 B2 7/2005 Taylor et al.
6,959,891 B2 11/2005 Kapiloff et al.
7,014,140 B2 3/2006 Elliott et al.
7,066,423 B2 6/2006 Andersson
7,083,138 B2 8/2006 Elliott et al.
7,093,737 B2 8/2006 Tramontina et al.
7,114,676 B2 10/2006 Elliott et al.
7,124,911 B2 10/2006 Tramontina et al.
7,131,609 B1 11/2006 Lewis et al.
7,168,653 B2 1/2007 Omdoll et al.
7,185,843 B1 3/2007 Li
D543,402 S 5/2007 Goeking et al.
7,219,852 B2 5/2007 Tramontina et al.
D543,745 S 6/2007 Goeking et al.
7,232,040 B2 6/2007 Decker et al.
7,270,292 B2 9/2007 Rasmussen
7,275,658 B2 10/2007 Decker et al.
7,287,720 B1 10/2007 Allegre et al.
7,312,782 B2 12/2007 Hiraki et al.
7,341,170 B2 3/2008 Boone
7,370,824 B1 5/2008 Osborne
7,374,065 B2 5/2008 Taylor et al.
7,422,174 B2 9/2008 Elliott et al.
7,460,013 B1 12/2008 Osborne
7,527,218 B2 5/2009 Brown
7,568,652 B2 8/2009 Cittadino et al.
7,624,664 B2 12/2009 Morris et al.
7,648,097 B2 1/2010 Cattacin et al.
7,726,515 B2 6/2010 Sherman et al.
7,841,556 B2 11/2010 Elliott et al.
7,841,558 B2 11/2010 Elliott et al.
7,861,964 B2 1/2011 Cittadino et al.
7,967,235 B2 6/2011 Forman et al.
8,016,155 B2 9/2011 Decker et al.
8,028,867 B2 10/2011 Sterngold et al.
8,162,252 B2 4/2012 Cittadino et al.
8,186,673 B2 5/2012 Michels
8,439,293 B2 5/2013 Hagleitner
8,464,976 B2 6/2013 Mok et al.
8,496,198 B2 7/2013 Cittadino et al.
8,550,396 B2 10/2013 Marrs
8,584,982 B2 11/2013 Eakin
8,616,117 B2 12/2013 Evers et al.
8,800,415 B2 8/2014 Osborne
8,800,910 B2 8/2014 Shepherd
8,882,021 B2 11/2014 Cittadino et al.
8,991,647 B2 3/2015 Meyers
9,138,110 B2 9/2015 Knight et al.
9,167,941 B2 10/2015 Cittadino et al.
9,296,546 B2 3/2016 Wichmann et al.
9,357,886 B2 6/2016 Duncan et al.
9,635,985 B2 5/2017 Phelps
9,635,986 B2 5/2017 Phelps
9,648,995 B2 5/2017 Elliott et al.
9,756,992 B2 9/2017 Osborne
9,861,238 B2 1/2018 Phelps
9,907,441 B2 3/2018 Osborne, Jr. et al.
9,918,598 B2 3/2018 Osborne
10,123,665 B2 11/2018 Osborne, Jr. et al.
10,136,769 B2 11/2018 Osborne, Jr. et al.
10,213,070 B2 * 2/2019 Osborne, Jr. ..... A47K 10/22
10,441,117 B2 10/2019 Osborne, Jr.

(56) References Cited

U.S. PATENT DOCUMENTS

| | | | | |
|---|---|---|---|---|
| 10,610,064 | B2 | 4/2020 | Osborne et al. | |
| 10,660,485 | B2 * | 5/2020 | Johnson | A47K 10/3687 |
| 2003/0146337 | A1 | 8/2003 | Moody et al. | |
| 2003/0168550 | A1 | 11/2003 | Formon et al. | |
| 2005/0167541 | A1 | 8/2005 | Osborne | |
| 2006/0236832 | A1 | 10/2006 | Cvjetkovic et al. | |
| 2007/0290094 | A1 | 12/2007 | Anderson | |
| 2008/0156926 | A1 | 7/2008 | Cattacin et al. | |
| 2010/0206979 | A1 | 8/2010 | Collins | |
| 2011/0042503 | A1 * | 2/2011 | Hagleitner | A47K 10/3687 242/560 |
| 2012/0312853 | A1 | 12/2012 | Osborne et al. | |
| 2013/0320130 | A1 | 12/2013 | Osborne | |
| 2014/0263811 | A1 | 9/2014 | Goeking et al. | |
| 2014/0263812 | A1 | 9/2014 | Osborne | |
| 2015/0157177 | A1 | 6/2015 | Carper et al. | |
| 2015/0265108 | A1 | 9/2015 | Brickl et al. | |
| 2015/0297043 | A1 | 10/2015 | Osborne et al. | |
| 2015/0327735 | A1 | 11/2015 | Himmelmann et al. | |
| 2016/0039348 | A1 | 2/2016 | Brower et al. | |
| 2016/0120376 | A1 | 5/2016 | Massey, Jr. | |
| 2016/0353945 | A1 | 12/2016 | Osborne | |
| 2016/0353946 | A1 | 12/2016 | Osborne | |
| 2016/0353947 | A1 | 12/2016 | Osborne | |
| 2016/0353948 | A1 | 12/2016 | Zhu | |
| 2016/0374521 | A1 | 12/2016 | Sherrill | |
| 2016/0374522 | A1 | 12/2016 | Sherrill | |
| 2017/0188760 | A1 | 7/2017 | Henson et al. | |
| 2017/0367547 | A1 | 12/2017 | Osborne | |
| 2018/0110380 | A1 | 4/2018 | Phelps | |
| 2018/0146829 | A1 | 5/2018 | Osborne | |
| 2018/0153360 | A1 | 6/2018 | Osborne, Jr. et al. | |
| 2018/0170703 | A1 | 6/2018 | Osborne, Jr. | |
| 2018/0263433 | A1 | 9/2018 | Osborne, Jr. | |
| 2018/0263435 | A1 | 9/2018 | Osborne, Jr. | |
| 2019/0174972 | A1 | 6/2019 | Osborne, Jr. et al. | |
| 2019/0216270 | A1 | 7/2019 | Osborne, Jr. | |
| 2019/0307299 | A1 | 10/2019 | Osborne, Jr. | |
| 2020/0029751 | A1 | 1/2020 | Osborne, Jr. | |
| 2020/0054177 | A1 | 2/2020 | Osborne, Jr. | |

FOREIGN PATENT DOCUMENTS

| | | | |
|---|---|---|---|
| GB | 2269361 | A | 2/1994 |
| JP | 07-275161 | A | 10/1995 |
| JP | 10-014819 | A | 1/1998 |
| WO | WO 2012/075504 | A1 | 6/2012 |

* cited by examiner

DISPENSING ASSEMBLY FOR SELECTIVELY DISPENSING A PLURALITY OF SUPPLIES OF ROLLED SHEET MATERIAL

CROSS-REFERENCE TO RELATED APPLICATIONS

The present application claims the benefit of U.S. Provisional Patent Application No. 62/778,570, filed on Dec. 12, 2018.

INCORPORATION BY REFERENCE

The disclosure and figures of U.S. Provisional Patent Application No. 62/778,570, filed on Dec. 12, 2018, are specifically incorporated by reference herein as if set forth in their entireties.

TECHNICAL FIELD

In one aspect, the present disclosure generally relates to dispensing assemblies and, more particularly, to dispensing assemblies for flexible sheet materials, such as paper products, e.g., tissue paper, paper towels, etc. Other aspects are also described.

BACKGROUND

Sheet material dispensers (e.g., for paper products, such as tissue, paper towels, etc.) are commonly used throughout various facilities, including restrooms or other area in hospitals, airports, bus stations, schools, etc. Such dispensers can include multiple supplies of sheet material and can be configured so that after one of the supplies of sheet material has been substantially exhausted or dispensed, an additional supply of the supplies of sheet material can be made available for further dispensing. Unfortunately, attempts are often made to improperly access or steal the supplies of sheet material from these dispensers or to otherwise tamper with or vandalize the dispensers. This can lead to increased paper supply costs and, in many instances, result in significant damage to the dispensers or components thereof. Accordingly, it can be seen that a need exists for a sheet material dispensing assembly that allows for selective dispensing of one or more supplies of sheet material, while also being substantially resistant to damage due to tampering or vandalism. The present disclosure addresses these and other related, and unrelated, problems or issues in the art.

SUMMARY

Briefly described, in one aspect, the present disclosure is directed to a sheet material dispensing assembly for dispensing a plurality of supplies of sheet material. The sheet material dispensing assembly can include a dispenser housing that supports the supplies of sheet material and that defines one or more compartments configured to receive and house the supplies of sheet material. The supplies of sheet material can include rolled paper products, such as rolled tissue paper, paper towel rolls, etc. or other suitable supplies of sheet material.

The dispenser housing also includes one or more discharge openings sized, dimensioned, or otherwise configured to provide or otherwise allow access to one or more of the plurality of supplies of rolled sheet material (e.g., access that allows users to pull or otherwise engage sheet material from one of the supplies for dispensing thereof).

The dispenser assembly further includes one or more brackets or carriers having a plurality of spindles or supports (e.g., a pair of spaced apart spindles) that receive and support a corresponding supply of sheet material within the one or more compartments of the dispenser housing.

In one aspect, the dispenser assembly can include a plurality of carriers that can be arranged in a spaced and/or segmented series along the dispenser housing.

The carriers generally are received along tracks (e.g., slots, grooves, or similar features) defined along the dispenser housing, with the carriers being moveable from a first dispensing position that provides access to a first supply of sheet material, but generally reduces, inhibits, or prevents access to a second supply of sheet material, and a second dispensing position that can provide access to the second supply of sheet material.

For example, when the first supply of sheet material has been substantially dispensed, the carriers can shift/move along the carrier tracks from the first dispensing position to the second dispensing position to allow user access to the second supply of rolled sheet material through the discharge opening(s) in the dispenser housing.

In addition, the dispenser assembly includes a carrier pivoting assembly rotatably connected to its carrier. Each pivoting assembly has a pivotable lever or frame moveably mounted to its associated carrier, enabling rotation or pivoting movement, and configured to engage one of the supplies of sheet material, e.g., the first supply supported by the carrier, such that the frame rotates/pivots as the first supply of sheet material is dispensed. For example, as the diameter of the first supply of sheet material diminishes or reduces due to dispensing thereof, the lever engaging the first supply of sheet material pivots, rotates, or otherwise moves therewith.

The pivoting assembly also includes pins or rods that are extensible and retractable from corresponding openings in the carriers. In a first or extended position, the pins can engage corresponding locking features (e.g., hooks, protrusions, tabs, recesses, etc.) arranged along the carrier tracks to hold and/or support the carriers in the first dispensing position. The pins further can be retractable to a second or retracted position upon rotation of the frame, in which the pins can move out of engagement with the locking features to cause or otherwise allow the carrier to move along the carrier tracks under its weight and the weight of the second/next supply of sheet material, to move the second supply of sheet material into a position for dispensing.

The pins can be connected to one end of the lever, and the pins can be positioned so as to be substantially coaxial in a spaced, opposing orientation or relationship and further can be biased by one or more biasing members (e.g., a tension spring or other suitable biasing member) that are attached to opposing ends of the pins.

The pins also can include one or more guidance features configured to engage or interact with one or more corresponding guidance features along the frame to guide or allow movement of the pins between their extended and retracted positions as the lever rotates or pivots. Thus, as the frame rotate in response to dispensing of the first supply of sheet material, the guidance features of the frame interact with the corresponding guidance features of the pins to cause or otherwise allow the pins to be retracted under the urging of the biasing member to the retracted position in which the pins no longer engage the corresponding locking features defined along the tracks, allowing the carrier to move to its second position for dispensing the second supply of sheet material.

In one construction, the guidance features can include corresponding guide surfaces provided along at least a portion of the frame and a body of the pins. The guide surfaces can be angled and generally complementary to one another such that as the lever is rotated the guide surfaces move in relation to each other to enable the biased pins to retract under the urging of the biasing member.

In an alternative construction, the guidance features can include a helical groove or slot defined along the body of the pins and a corresponding tab or other projecting portion configured to be received within the helical groove provided on at least a portion of the frame.

The lever or frame further can include a roller rotatably attached thereto that is configured to engage the first supply of sheet material, with the carrier in that first dispensing position.

In one construction, the locking features can include a base portion that is secured to the dispenser housing along the track, a flexible elongated portion connected to the base portion at one end of the elongated portion, and a tab portion connected to the elongated portion at an opposing end of the elongated portion. The tab portion can be configured to engage a corresponding biased pin of the plurality of biased pins.

In an alternative construction, the locking features can include a flexible elongated portion that is integrally formed with a wall of the track and positioned within an opening defined there include, and a tab portion connected to the elongated portion that is configured to engage a corresponding biased pin.

The track can include a track offset that moves the second supply of sheet material towards the one or more discharge openings when the carrier is moved towards and/or to the second dispensing position.

The dispenser housing can include a cover and the track can be defined within the cover. In an alternative construction, the track can be defined in a separate component connected to or otherwise formed with the dispenser housing.

These and other advantages and aspects of the embodiments of the disclosure will become apparent and more readily appreciated from the following detailed description of the embodiments and the claims, taken in conjunction with the accompanying drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the embodiments of the present disclosure, are incorporated in and constitute a part of this specification, illustrate embodiments of the invention, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

The following description is provided as an enabling teaching of embodiments of this disclosure. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the present disclosure and not in limitation thereof.

FIGS. 1-11 illustrate a sheet material dispenser assembly 10 that facilitates selective dispensing of sheet materials from a plurality of supplies of sheet material 12 received therein, according to various aspects of the present disclosure. The supplies 12 of sheet material include rolled paper products, such as perforated or unperforated tissue rolls, paper towel rolls, etc., though any suitable sheet material supplies and/or products can be used without departing from the scope of the present disclosure.

Figure 1:
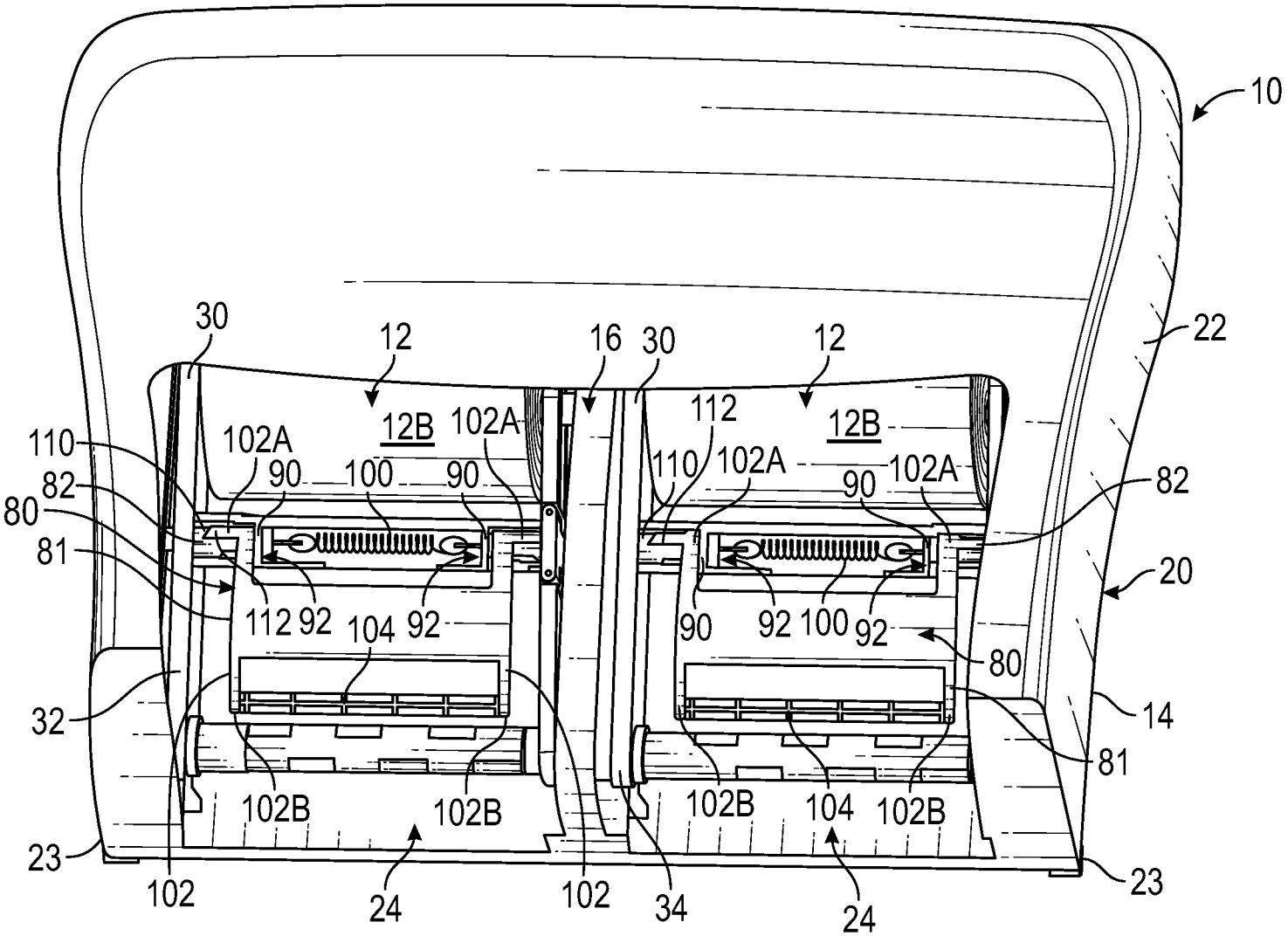
FIG. 1 shows a front view of a sheet material dispensing assembly according to one aspect of the present disclosure.
Figure 2:
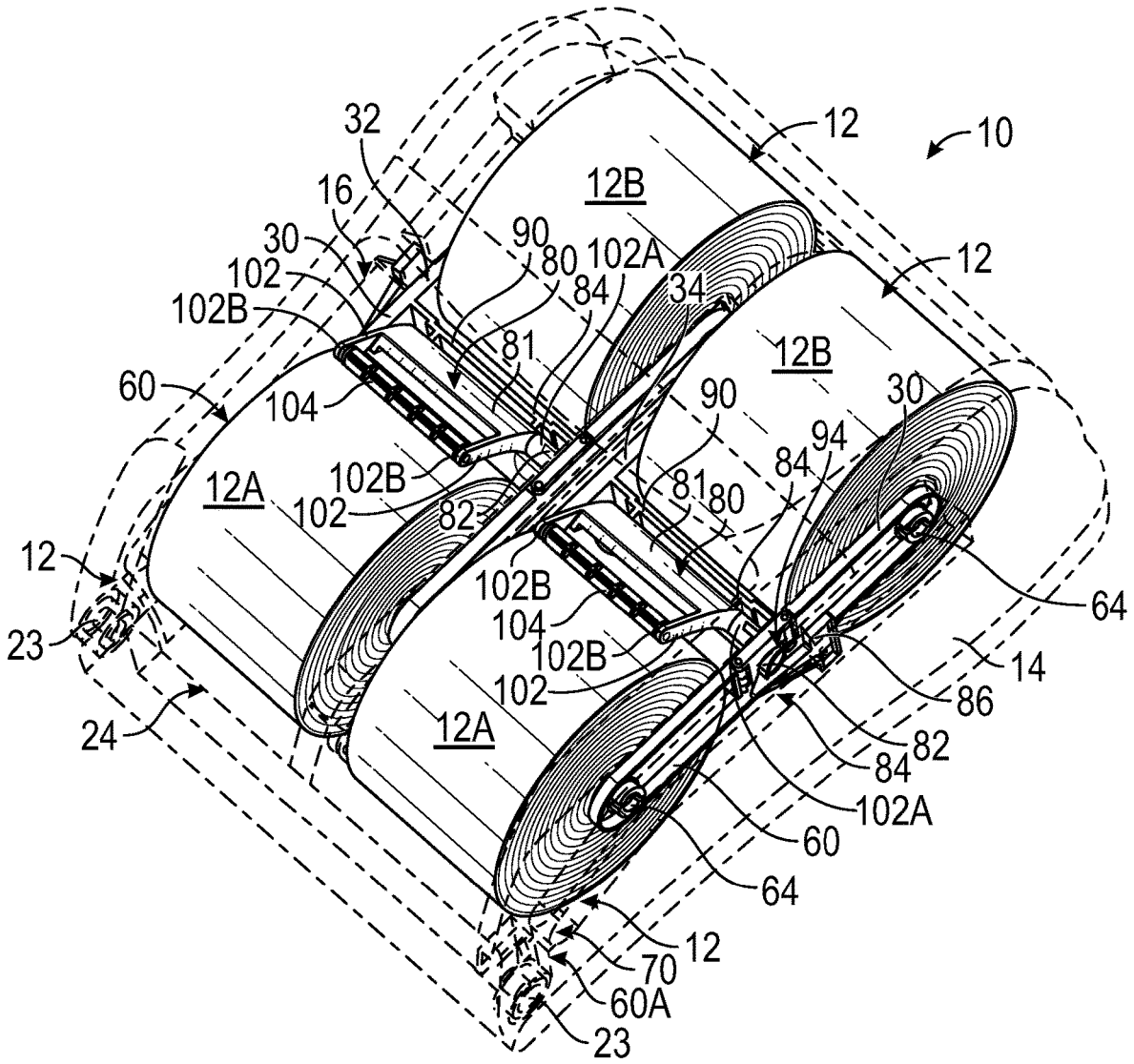
FIGS. 2 and 3 show perspective views of the sheet material dispensing assembly according to FIG. 1, with the housing of the dispenser assembly shown in dashed lines.
Figure 3:
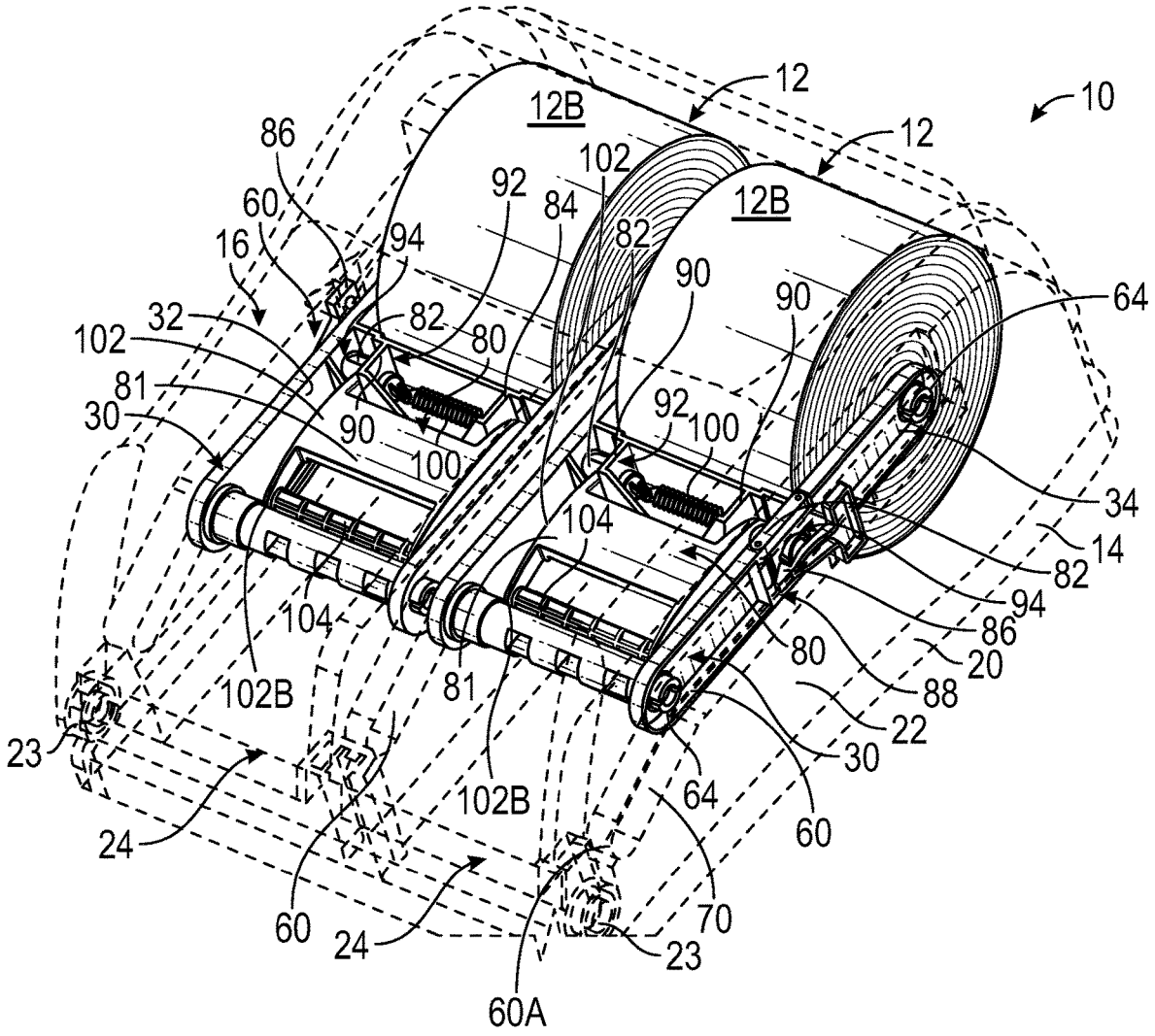

As shown in FIG. 1, the dispenser assembly 10 includes a dispenser housing 14 having one or more chambers or compartments 16 defined therein for receiving a plurality of supplies 12 of sheet material. The dispenser housing 14 also can include a base or back portion 20 that can be configured to facilitate mounting of the dispensing assembly 10 to a surface, such as to a wall or other suitable support (e.g., along a wall in a bathroom, a portion of a bathroom stall, or other suitable location). A moveable cover 22 can be coupled to the base 20, including being detachably coupled (e.g., by snap fittings, fasteners, etc.) and/or can be rotatably mounted to the base 20, such as by one or more hinges 23 to facilitate opening and closing of the cover 22, as shown in FIGS. 1-3. The cover 22 is moveable to an open position or can be removed, as needed, to facilitate access to the chamber 16 within the interior of the dispenser housing for loading and unloading of the new and exhausted supplies 12 of sheet material within the chamber 16. The dispenser housing 14 generally can be formed from plastic materials, such as acrylonitrile butadiene styrene ("ABS), polyoxymethylene ("POM"), etc., though other suitable materials, e.g., other polymeric, synthetic, composite, metallic materials, etc., or combinations thereof, can be employed without departing from the scope of the present disclosure.

FIGS. 1-3 further show the dispenser housing 14 having one or more openings, apertures, or discharges 24, e.g., defined in or otherwise along the cover 22, that are sized, dimensioned, or configured to provide access to the supplies of rolled sheet material 12 supported in the dispenser housing 14. Other types of openings and locations also can be provided. To dispense the sheet material from the dispenser assembly 10, users can engage and pull a portion of sheet material (e.g., a hanging tab) from the supplies 12 through the opening(s) 24 and then tear off a selected or desired amount thereof. The sheet material can be perforated or precut to facilitate tearing or detachment of selected amounts thereof, though the sheet material can be substantially continuous, i.e., not perforated or precut, without departing from the scope of the present disclosure. In some embodiments, the dispenser assembly 10 also can include a cutting mechanism, e.g., a jagged edge or blade(s), disposed along the opening(s) 24 to facilitate tearing or detachment of selected amounts of sheet material.

As additionally illustrated in FIGS. 1-5, the dispenser assembly 10 includes one or more carriers or brackets 30 configured to support the plurality of supplies 12 of sheet material within the dispenser housing 14. FIGS. 1-3 show that the dispenser assembly 10 includes at least a first carrier 32 and a second carrier 34, e.g., that are arranged in spaced series within the dispenser housing 14, though any number of carriers 30 can be used, e.g., one or more than two, without departing from the scope of the present disclosure.

Figure 4:
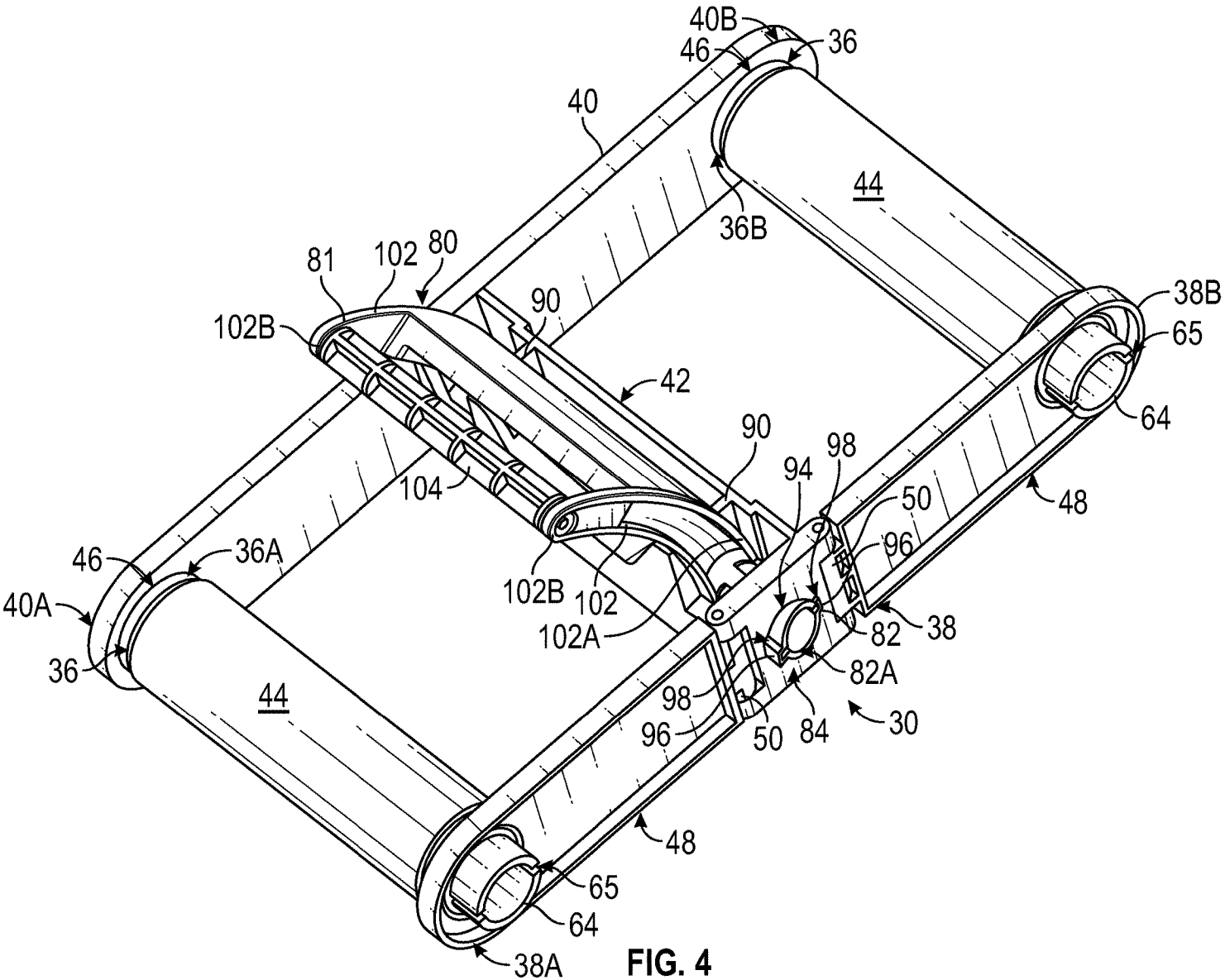
FIG. 4 shows a perspective view of a pivoting assembly for the sheet material dispensing assembly of FIG. 1, with its pins in an extended position.
Figure 5:
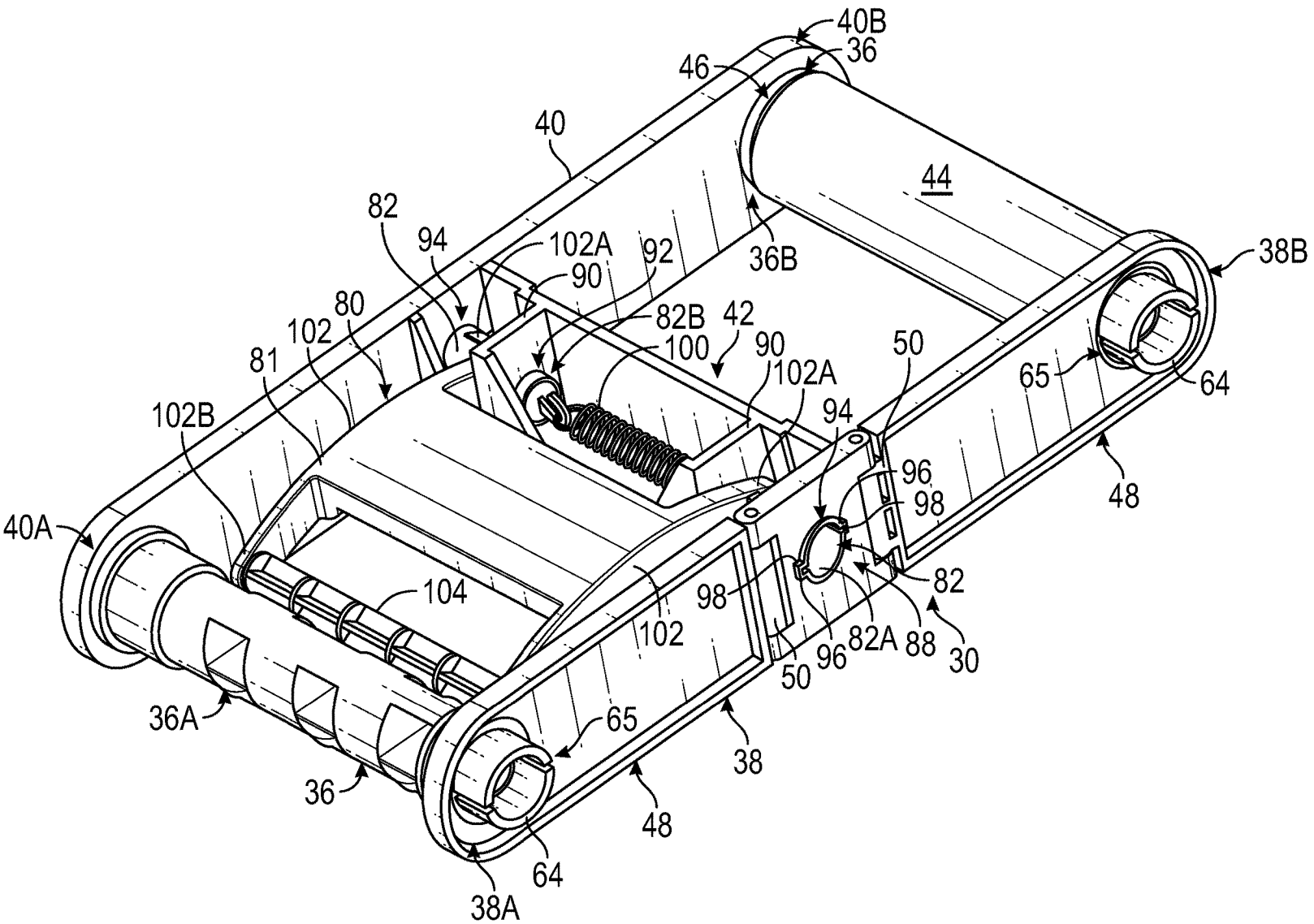
FIG. 5 shows a perspective view of the pivoting assembly for the dispensing assembly of FIG. 1, with the pins in a retracted position.

FIGS. 4-5 show perspective views of the carriers 30 according to one aspect of the present disclosure. As shown in FIGS. 4-5, each carrier 30 has a pair of spaced spindle holders 36 including a first, lower spindle holder 36A and a second, upper spindle holder 36B, and a pair of opposing side rails or supports 38 and 40 connected to and supporting the spindle holders 36A/36B. The carriers 30 also include a cross-support or member 42 extending between and connecting the opposing side rails 38 and 40, e.g., to provide a generally H-shaped configuration, though other shapes or configurations are possible without departing from the scope of the present disclosure. The carriers 30 can hold multiple supplies of sheet material and generally are formed from a plastic material, such as ABS, POM, etc., though other suitable materials, e.g., other polymeric, synthetic, composite, metallic materials, or combinations thereof, can be employed without departing from the scope of the present disclosure.

The first, lower spindle holder 36A generally is disposed at, or substantially adjacent to, a first, lower end 38A/40A of the side rails 38/40, while the second, upper spindle holder 36B is disposed at, or substantially adjacent to, a second, upper end 38B/40B of the side rails 38/40. Each of the spindle holders 36 rotatably supports a respective supply of sheet material 12. Typically, each supply of sheet material 12 includes a prescribed amount of sheet material wrapped about a spindle 44 receives a corresponding spindle holder 36. For example, each spindle 44 can have a bore 46 defined therethrough that is sized, dimensioned, and/or configured to receive a spindle holder 36, such that the spindle 44 and its wrapped supply of sheet material are supported by and rotatable with the spindle holder 36 (FIGS. 4-5).

FIGS. 4-5 show at least one of the side rails 38/40 of the carriers 30 including movable or removable portions or sections 48 that can help facilitate the loading/unloading of the supplies of sheet material 18 to and from the spindle holders 36. In the illustrated embodiment, the side rail 38 includes portions 48 that are pivotally or rotatably mounted to the carrier 30, e.g., by one or more hinges 50 or other suitable rotatable/pivotable connection mechanisms. The pivoting portions 48 further will be connected to the spindle holders 36 by a snap fitting, frictional fit, or other releasable connection. As a result, the pivoting portions 48 can be disconnected from the spindle holders 36 and pivoted/rotated to facilitate loading of new supplies of rolled sheet material and unloading of dispensed/depleted supplies of rolled sheet materials. In alternative constructions, the opposing side rail 40 can include one or more pivoting or rotating portions 48 that facilitate loading/unloading of the supplies 12 of sheet material. Other constructions also are possible, e.g., one or more of the side rails 38/40 can include portions that are completely removable from the spindle holders 36 to facilitate loading/unloading of supplies of sheet material.

Turning again to FIGS. 2-3, in the illustrated embodiment, the dispenser assembly 10 further includes tracks 60, e.g., including slots, channels, etc., defined within the cover 22 and/or the dispenser housing 14. These tracks 60 generally are configured to receive and guide movement of the carriers 30 between first and second positions. In alternative constructions, the tracks 60 can be defined in separate members or parts 62 that can be attached to one or more components of the dispenser housing, e.g., the base 20, cover 22, or other suitable component or combinations thereof (FIGS. 6A-6D). As further indicated in FIGS. 2-5, the side portions 38/40 of the carriers 30 can have guides or projections 64 that are received within and ride along the tracks 60. In the illustrated embodiment, the guides 64 have a generally cylindrical shape with a channel or notch 65 defined therethrough, though other shapes or configurations, e.g., spherical, cubic, etc., are possible without departing from the scope of the present disclosure. The channel 65 generally allows for movement of the guides 64 over locking features 86 provided along the tracks 60, as discussed further below.

Figure 6B:
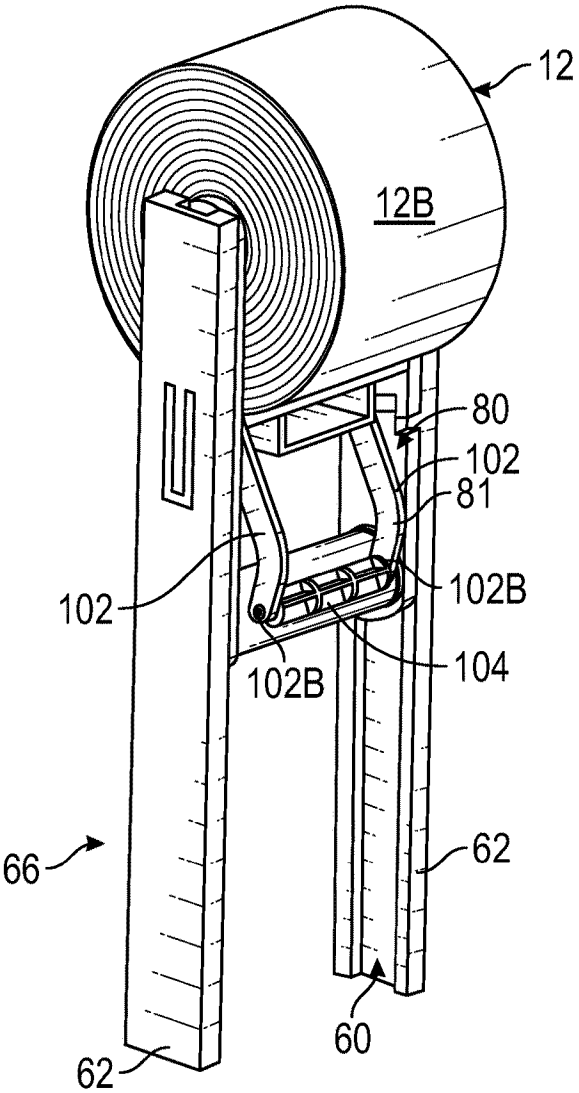
FIGS. 6A-6D show perspective views of the carrier moving between a first dispensing position and a second dispensing position.
Figure 6A:
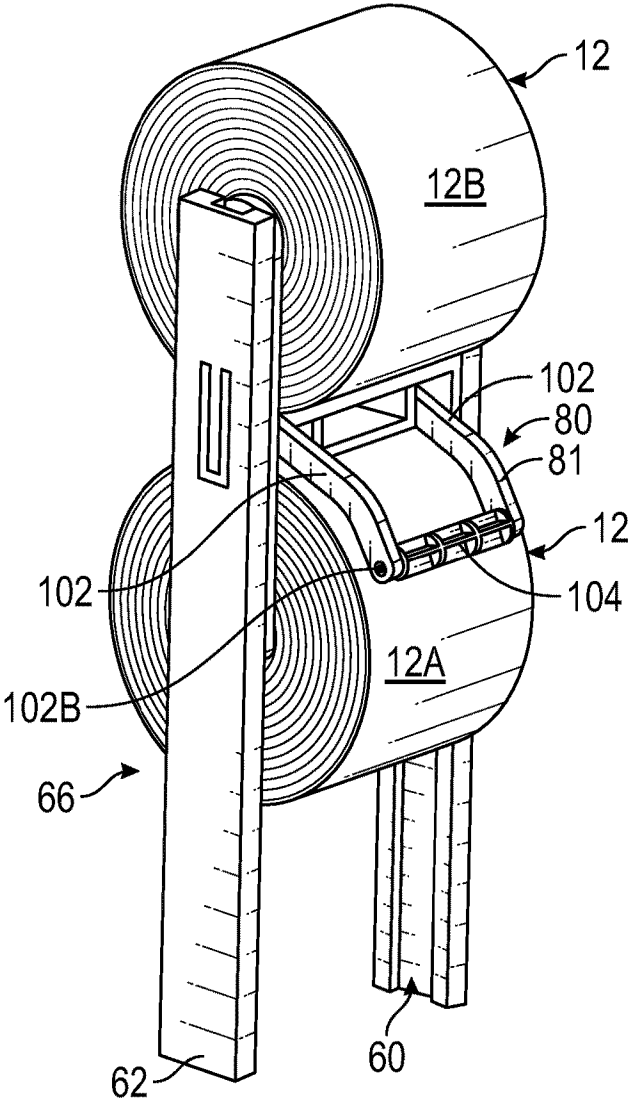
Figure 6D:
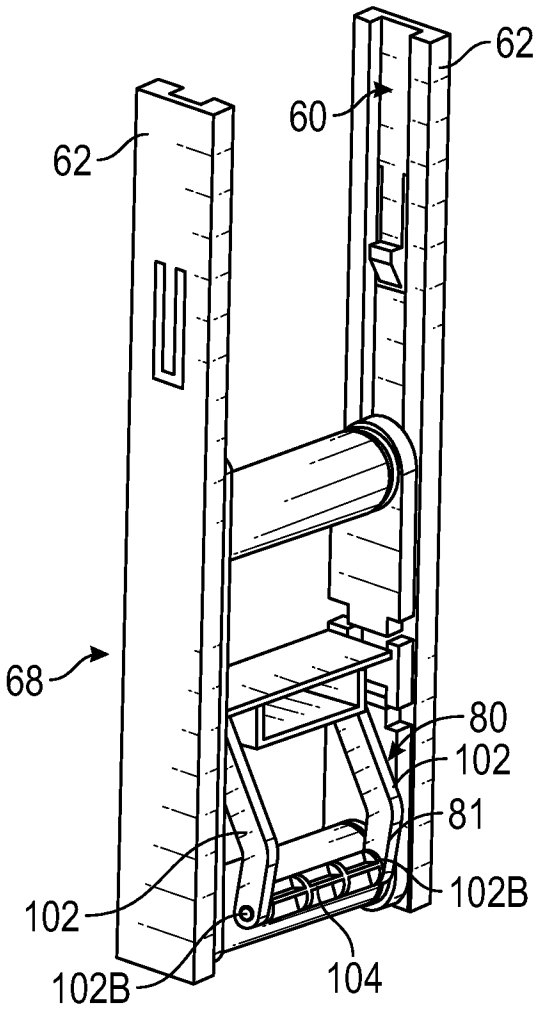
Figure 6C:
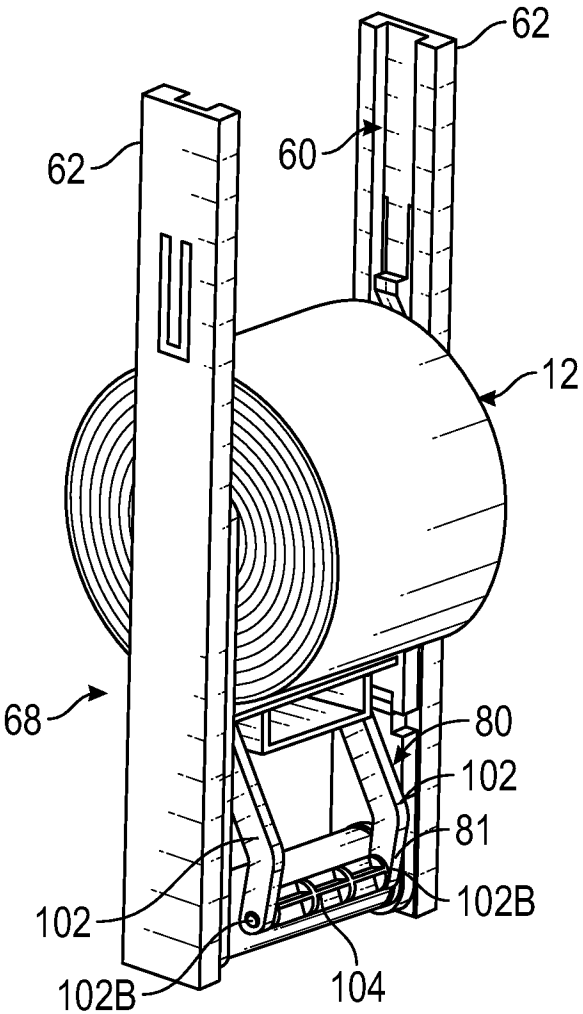

FIGS. 6A-6D illustrate movement of the carrier 30 between various positions. As shown in FIGS. 6A-6D, the carriers 30 are moveable along the tracks 60 from a first dispensing position shown at 66 (FIG. 6A-B), which can provide access to a first, lower supply 12A of sheet material 12 and can substantially reduce, prevent, or inhibit access to a second, upper supply 12B of sheet material, to a second dispensing position, shown at 68 (FIG. 6C-D), which provides access to the second, upper supply 12B of sheet material. For example, in the first dispensing position 66, users can access and engage the first, lower supply 12A of sheet material through the opening 24 for dispensing thereof, but the seconded, upper supply 12B of sheet material can be substantially obstructed by the cover 22, such that access to the second, upper supply 12B of sheet material is substantially reduced, prevented, or inhibited. When the first supply of sheet material 12A is substantially dispensed as shown in FIG. 6B, the carrier 30 shifts or moves along the track 60 from the first dispensing position 66 toward the second dispensing position 66, as shown in FIG. 6C, to provide of otherwise allow access to the second, upper supply 12B of sheet material through the opening 24 for dispensing thereof.

In the illustrated construction, the tracks 60 are shown to have an offset or angled portion 70 at a lower end 70A. This offset portion 70 is configured to move or shift the carrier 30 as it moves along the tracks, such that the second, upper supply 12B of sheet material is moved toward and positioned sufficiently adjacent to the opening(s) 24 to facilitate access thereto in the second dispensing position 68 (FIGS. 4-5). The offset 70 further can help to reduce the overall dimensions (e.g., the height) or size footprint of the dispenser housing 14. The tracks 60 can have any suitable construction or configuration, however, without departing from the scope of the present disclosure, e.g., in alternatives construction, the tracks 60 can be generally straight from end to end, as indicated in FIGS. 6A-6D.

The dispenser assembly 10 also includes a carrier pivoting assembly 80 associated with each carrier 30 (e.g., in FIG. 1, a pair of carriers 30 are shown, each with a carrier pivoting assembly 80 associated therewith). As shown in FIGS. 1-7, the pivoting assembly 80 includes pivotable or rotatable levers or frames 81 moveably mounted to each carrier 30 and configured to engage the first supply 12A of sheet material. For example, as indicated in FIGS. 6A-6D, the lever 81 rotates/pivots as a first, lower supply 12A of sheet material is dispensed, i.e., as the diameter of the supply 12A is diminished or reduced during such dispensing.

Figure 7:
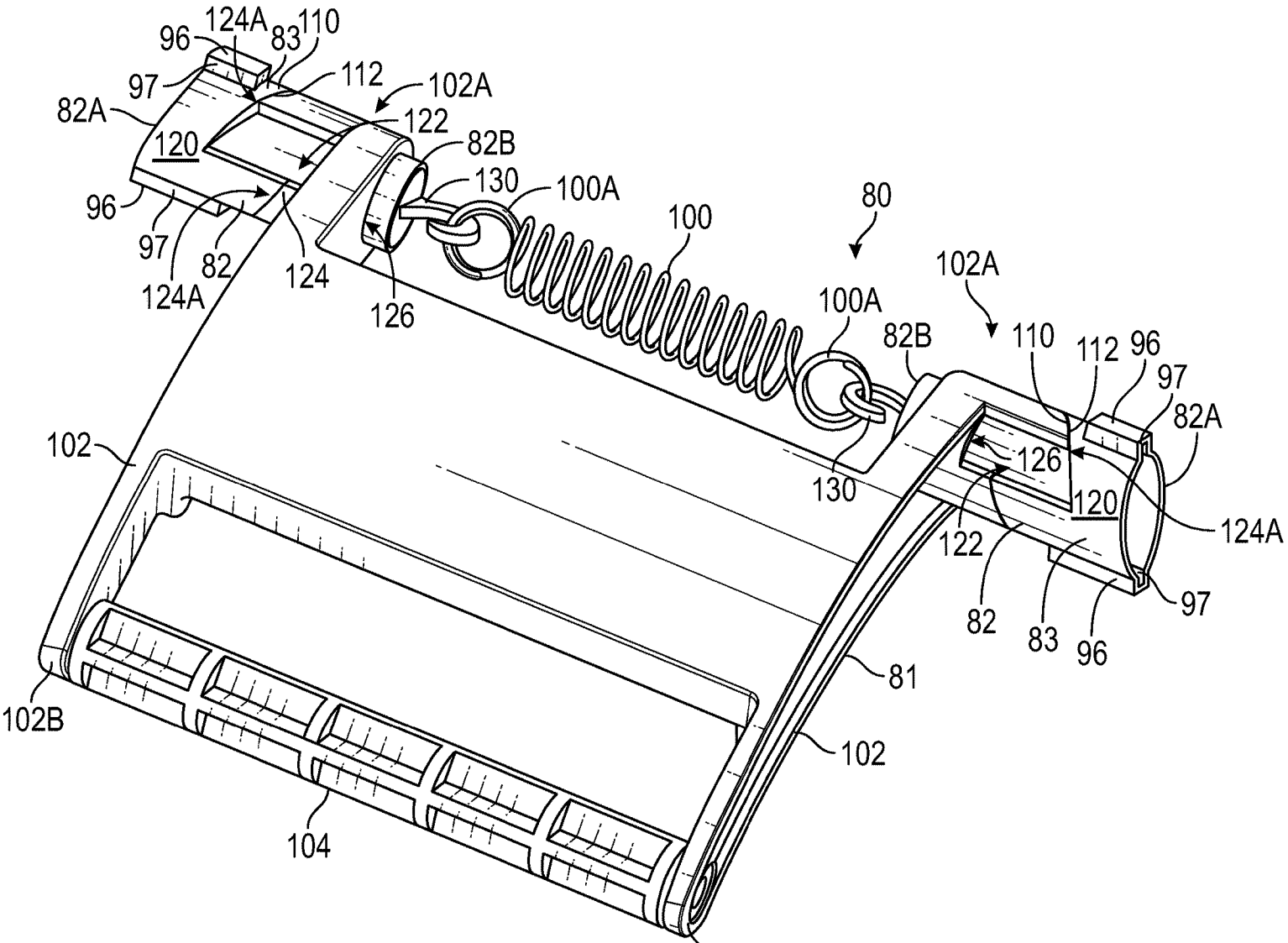
FIG. 7 shows perspective and partial perspective views of the rotatable frame according to one aspect of the present disclosure.
Figure 8:
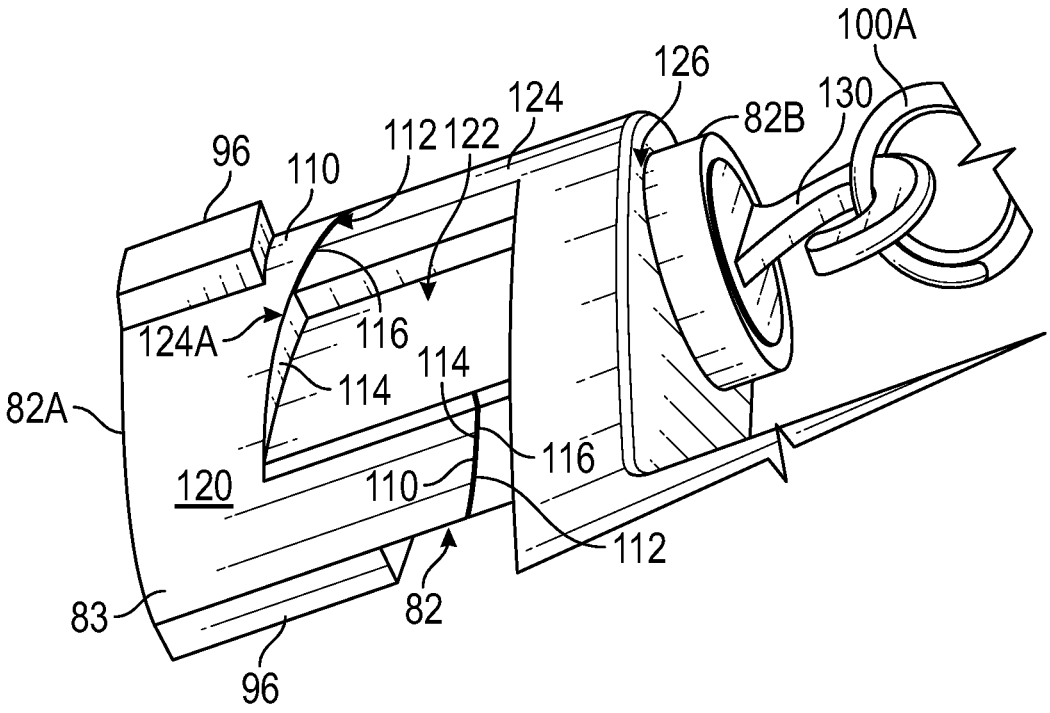
FIG. 8 shows a partial, perspective view of a pin according to one aspect of the present disclosure.
Figure 9:
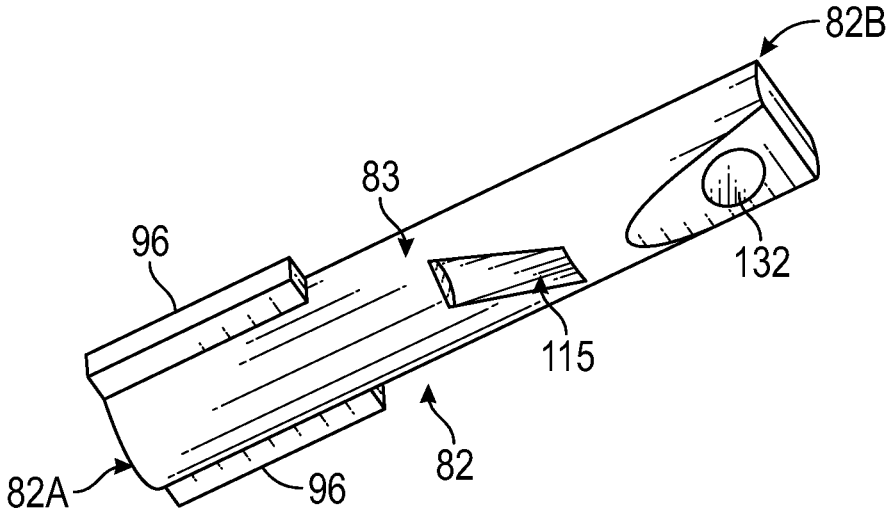
FIG. 9 shows a perspective view of a pin according to one additional aspect of the present disclosure.

The pivoting assembly 80 additionally includes a pair of pins or rods 82 attached to or otherwise in communication with the lever 81, for operatively connecting the lever 81 to the carrier 30 (FIGS. 1-5, 7-9, and 10A-10B). FIGS. 8 and 9 show perspective views of the pins 82 according to various aspects of the present disclosures. As illustrated, the pins 82 have a generally cylindrical body 83, and move laterally with rotation/pivoting of the lever 81 so as to move between an extended position 84, in which the pins 82 engage corresponding locking features 86 (e.g., hooks, protrusions, tabs, recesses, etc.) arranged along the tracks 60 to hold/support the carriers 30 in the first dispensing position 66, and a retracted position 88, in which the pins 82 are moved out of engagement with the locking features 86 to enable the carrier 30 to move along the tracks 60 to the second dispensing position 68, as generally shown in FIGS. 4-5 and 10A-10B. Accordingly, as the lever 81 rotates due to the reduction in the diameter of the first or lower supply 12A of sheet material during dispensing, the pins 82 are caused to move from their extended positions 84 toward their retracted positions 88, and when the first supply 12A of sheet material is substantially dispensed/exhausted to the desired extent, the pins 82 disengage the locking features 86 to allow the carrier 30 to move/slide, under its own weight (and/or together with that of the upper supply roll 12B), along the track 60 from the first dispensing position 66 to the second dispensing position 68.

As further shown in FIGS. 1-5, the cross-support 42 of carrier 30 generally will include one or more walls, flanges, or partitions 90, or other suitable portions, that facilitate attachment of the pins 82 to the carrier 30. These walls or flanges 90 each can have openings or passages 92 defined therethrough for receiving at least a portion (e.g., an end portion 82B) of the pins 82, with an opposite portion of each pin 82 (e.g., an end portion 82A) further being received within a corresponding opening or passage 94 defined through the sidewall 38/40 of the carrier to couple each pin 82 and the pivoting assembly 80 to the carrier 30. The pins 82 thus are arranged to be on a coaxial, in a spaced-part, opposing relationship/orientation, as FIGS. 5 and 7 generally indicate.

The pins 82 additionally are moveable into and out from their corresponding openings 94 in the side walls 38/40 of the carrier 30 upon rotation of the lever 81. FIGS. 4-5, 7-9 and 10A-10B show the pins 82 including locating tabs 96 projecting from the body 83 of each pins 82 and disposed along, or substantially adjacent the first end portion 82A of the pins 82. The locating tabs 96 can include a generally rectangular body 97, though other shapes are possible, and will be configured to be received within complementary slots or grooves 98 defined in the side rails 38/40. The slots 98 are in communication with the openings 94 to help locate and guide the pins 82 in and out from the openings 94 (FIGS. 4, 5, 10A, and 10B). The pins 82 further are connected to one or more biasing members 100, such as one or more tension springs or other suitable biasing members. The pins 80 are urged by the biasing member(s) 100 toward their retracted positions 88. The walls 90 further can engage at least a portion of the pins 82 (e.g., end portion 82B) to help to reduce, prevent, or inhibit bending, buckling, or other unwanted side-to-side movement of the pins 82.

FIGS. 1-7 further illustrate that the lever 81 includes side portions or sections 102 rotatably, pivotally, or otherwise movably coupled to the pins 82 at a first end 102A thereof and also coupled to and supporting a roller 104 at a second end 90B thereof. The roller 104 is rotatably coupled to the side portions 102 of the lever, e.g., by bearings, bushings, etc., and is configured to engage the first, lower supply 12A of sheet material (FIG. 2), such that the roller 92 rotates as the first, lower supply 12A of sheet material is rotated during dispensing (e.g., when a user engages a pulls sheet material from the supply 12A).

In addition, as shown in FIGS. 1 and 7-8, the pins 82 include one or more guidance features 110 that engage or otherwise interact with corresponding guidance features 112 arranged along the lever 81 to guide or allow movement of the pins 82 between their extended 84 and retracted 88 positions as the lever 81 is pivoted/rotated during dispensing of the first, lower supply 12A of sheet material. Thus, as the lever 81 rotates or pivots about the pins 82, with the dispensing of the first, lower supply 12A of sheet material, the guidance features 110/112 interact to cause or allow the pins 82 to be retracted under the urging or force of the biasing member 100 to move the pins toward their retracted position 88 and disengage from the locking features 86 defined along the track 60. This in turn enables the carrier 30 to move (e.g., under its own weight and the weight of the second supply 12B) the second supply 12B to the second position 68 for dispensing sheets therefrom.

In the construction illustrated in FIG. 7, the guidance features 110 include slanted or angled guide surfaces or faces 114 defined along the body 83 of the pins 82, and the guidance features 112 include corresponding, complementary guide surfaces 116 defined along the first end 102A of the side portions 102. These guide surfaces 114/116 generally are shaped, sized, or otherwise configured to guide movement of the pins 82 (e.g., under urging of the biasing member) towards their retracted position 88. As the lever 81 is rotated/pivoted, the guide surfaces 116 of the pins 82 are moved along or otherwise in relation the guide surfaces 114 of the lever 81 to enabling the pins 82 to be moved under urging of the biasing member 100 toward their retracted position 88.

In one alternative construction, such as shown in FIG. 9, the guidance features 110/112 can include a helical slot or recess 115 defined along each pin, and a corresponding tab or other suitable protruding portion (not shown) along the end 102A of side portion 102 of the lever 81. This helical slot 115 can be selectively engaged by the tab to allow the pins to move under the force of the biasing member from the extended or retracted position to the second position.

Furthermore, as shown in FIGS. 7 and 8, the body 83 of the pins 82 includes a generally cylindrical sidewall 120 with one or more reduced area or recessed portions 122 defined therein that form or otherwise define the guide surfaces 114. The second end 102A of the side portion 102 of the lever 81 also can include a cylindrical projection 124, with an end portion 124A that is angled or offset to define the guide surfaces 116. The cylindrical portion 124 also can include a passage/hole 126 in which the body 83 of a pin 82 can be at least partially received. For example, the recessed area 122 of the body 83 of each pins 82 is received within a hole or passage 126 to enable the lever 81 to be rotatable about the pins 82.

As also illustrated in FIG. 7, the pins 82 generally are attached to the lever 81 in an aligned, substantially coaxial, spaced apart, opposing relationship/orientation. The pins 82 further are operatively connected and biased towards each other by the biasing member 100. In one construction, as shown in FIG. 7, the second end portion 82B of each pin 82 includes a hook 130 that engages a hooped or hooked end 100A of the biasing member 100. In an additional or alternative construction, as shown in FIG. 9, the second ends 82B of the pins 82 can have an opening or passage 132 defined therethrough and configured to engage the hooked or hooped end 100A of the biasing member 100. The biasing member 100 provides a tension or pulling force that urges the spaced pins 82 towards one another, such that the guidance features 110/112 are pressed into contact or engagement with each other.

The components of the pivoting assembly 80, e.g., the frame 81 and the pins 82, are generally are formed from a plastic material, such as ABS, POM, etc., though other suitable materials, e.g., other polymeric, synthetic, composite, metallic materials, or combinations thereof, can be employed without departing from the scope of the present disclosure. The pivoting assembly 80's construction further is designed to be substantially resistant to damage caused by tampering or vandalism, for example, if someone pulls on the carrier 30 or the lever 81, such as in an attempt to tamper with or vandalize the dispenser assembly 14, the pins can release or disengage to avoid damage to the carrier body and/or housing. The lever 81 further can include a cross-bar or member 134 that extends between the side sections 102, e.g., to increase the stiffness/rigidity of the lever 81 and help prevent damage thereto if the dispenser assembly 10 is tampered with or vandalized. The cross member 134 is optional, however, and can be omitted, as indicated in FIGS. 6A-6D.

Figure 10B:
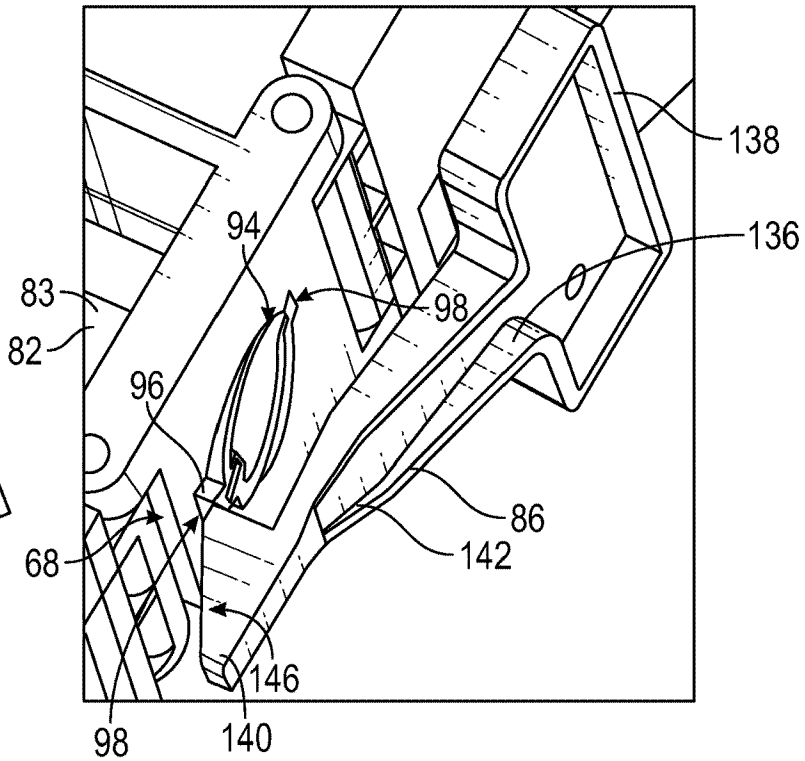
FIGS. 10A-10B show perspective views of locking features according to one aspect of the present disclosure.
Figure 10A:
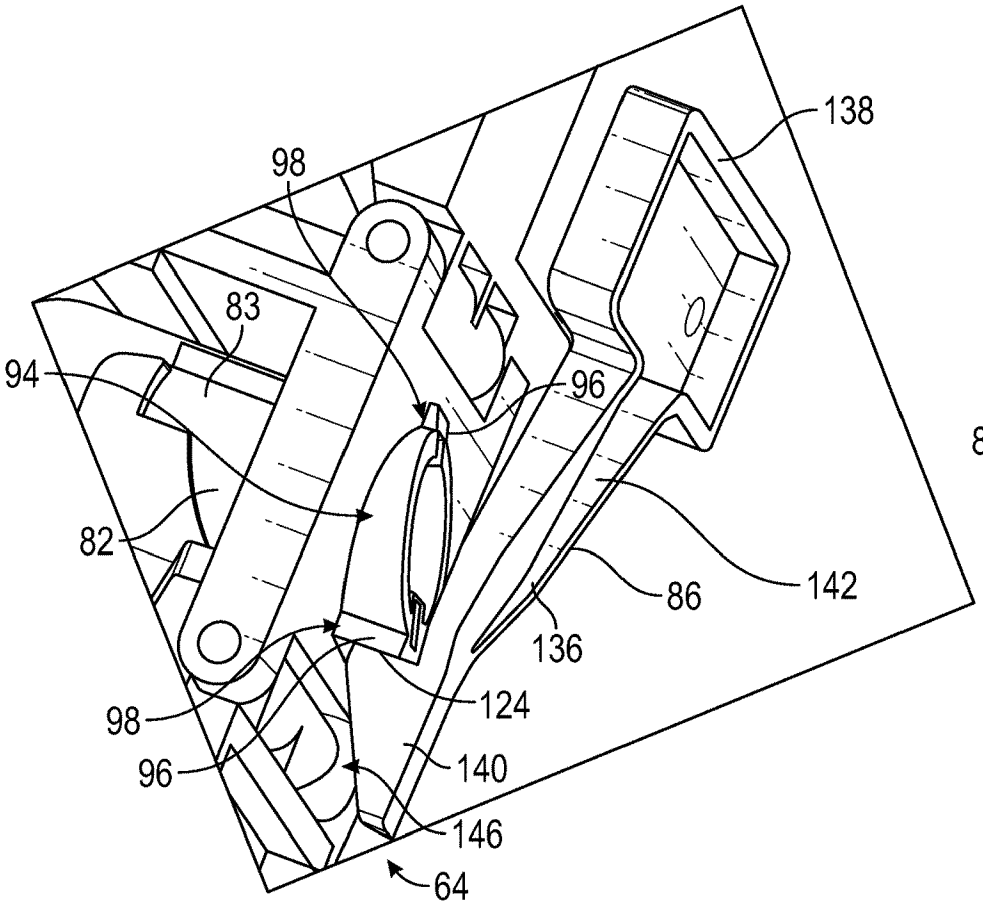
Figure 11:
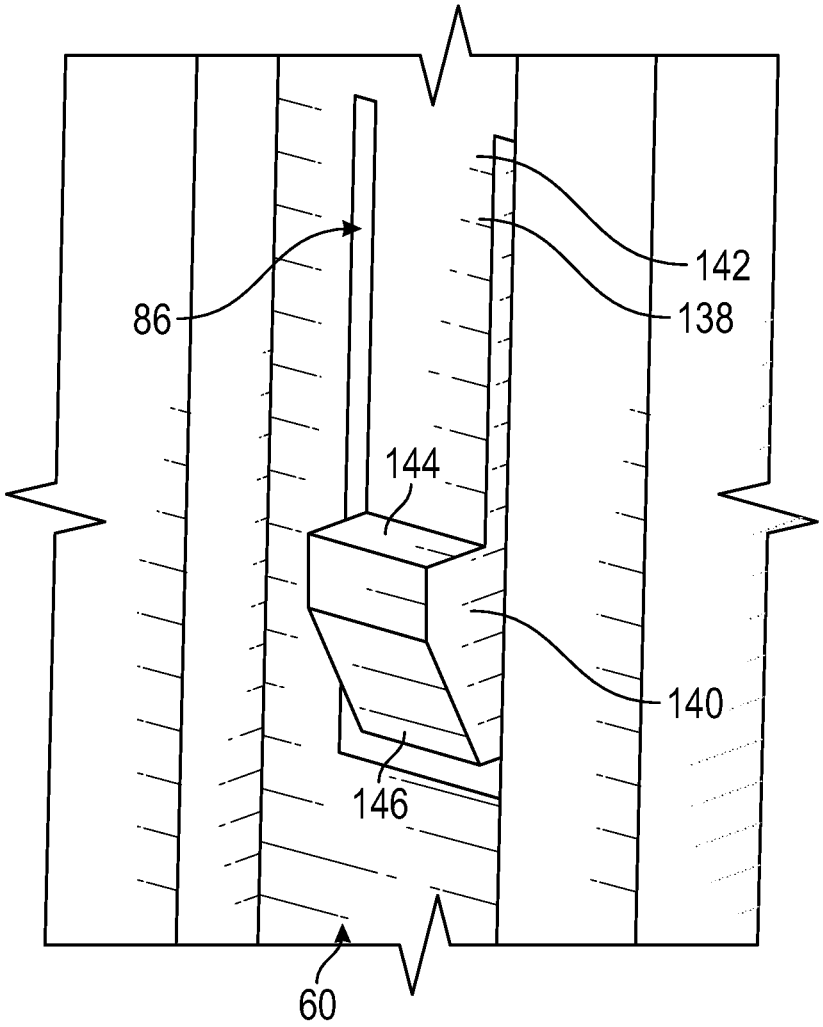
FIG. 11 shows a perspective view of locking features according to one additional aspect of the present disclosure.

FIGS. 10A-10B and 11 show perspective views of locking features 86 according to various aspect of the present disclosure. In one construction, as shown in FIGS. 10A-B, the locking features 86 can include a body 136 with a base portion 138 that is connected to the cover 22 along the track 60 (e.g., by fasteners, such as screws, bolts, etc., or other suitable connection mechanism, e.g., adhesives). The body 136 further can include a tab portion 140 that is connected to the base portion 138 by a flexible elongated portion or section 142. The tab portion 140 includes a surface or shoulder 144 that is configured to engage the pins 82 in their extended position 84, and an opposing surface or face 146 that is slanted or angled to allow for loading of the carrier 30 within the tracks 60. For example, when the carrier 30 is loaded and within the tracks 60, the pins 82 may engage the slanged or angled surface 146 to move/bend the flexible portion 140 and the tab 140 attached thereto to allow passage of the pins 82 and thus the carrier 30 to be loaded into its first dispensing position/configuration 66. Furthermore, the channels 65 defined in the guides 64 of the carrier 30 are sized, dimensioned, or otherwise configured to allow for passage of the tab portions 140 therethrough to allow for movement of the guides 64 over the locking features 86.

In an additional or alternative constructions, the locking features 86 can be integrally formed within the tracks 60, as indicated in FIG. 11. For example, FIG. 11 shows that the locking features 86 can be positioned within a hole or opening 150 defined in a wall or portion 152 of the track 60, and the elongated flexible portion 144 is formed with the wall 152 of the track 60. The locking features 86 further may be moveable into the opening 150 to allow the carrier 30 to be loaded or received within the tracks 60, and further to allow the carrier 30 to be released from the track 60 if it is pulled or engaged, e.g., when someone attempts to tamper with or vandalize the dispenser assembly.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A dispenser assembly for selectively dispensing sheet materials from a plurality of supplies of sheet material, comprising:

a dispenser housing configured to receive the plurality of supplies of sheet material therein, the dispenser housing having one or more discharge openings configured to enable access to at least one of the plurality of supplies of sheet material;

at least one carrier having a carrier body with a plurality of spindles spaced therealong, each spindle configured to receive a first or second supply of sheet material of the plurality of supplies of sheet material, and the at least one carrier configured to move along a track defined along the dispenser housing between a first dispensing position for dispensing of the first supply of sheet material and a second dispensing position for dispensing of the second supply of sheet material; and a carrier pivoting assembly rotatably connected to the at least one carrier, and comprising:

a pivotable lever configured to engage the first supply of sheet material when the at least one carrier in the first dispensing position, wherein the lever pivots as sheet material is dispensed from the first supply of sheet material; and a plurality of biased pins connected to the lever and configured to engage locking features arranged along the track for supporting the carrier in the first dispensing position, each of the plurality of biased pins including a guidance feature that interacts with a corresponding guidance feature of the lever such that the plurality of the biased pins are retracted with rotation of the lever and disengage from the locking features when a selected amount of sheet material of the first supply of sheet material has been dispensed to enable the carrier to move along the track to the second dispensing position for positioning the second supply of sheet material for access to and dispensing of the second supply of sheet material.

2. The dispenser assembly of claim 1, wherein the plurality of biased pins includes a pair of opposing biased pins connected to an end of the lever in a spaced relationship, and wherein the carrier pivoting assembly further comprises a biasing member connected to each of the pair of opposing biased pins.

3. The dispenser assembly of claim 2, wherein the guidance feature of the biased pins includes guide surfaces defined along each of the biased pins, and the guidance feature of the lever includes one or more guide surfaces defined adjacent an end of the lever and configured to engage corresponding guide surfaces of the biased pins.

4. The dispenser assembly of claim 3, wherein the guide surfaces of the biased pins are angled, and the guide surfaces of the lever are generally complementary to the one or more guide surfaces of the biased pins such that as the lever is rotated, the guide surfaces of the biased pins are moved in relation to the guide surfaces of the lever to cause the biased pins to retract under the urging of the biasing member.

5. The dispenser assembly of claim 2, wherein the guidance feature of the biased pins includes a helical slot defined in a body of each biased pins, and wherein the corresponding guidance feature of the lever includes a tab configured to be received within the helical slot of the biased pins.

6. The dispenser assembly of claim 1, wherein the lever comprises a roller configured to engage the first supply of sheet material when the carrier is in the first dispensing position.

7. The dispenser assembly of claim 1, wherein the one or more locking features each include a flexible elongated portion integrally formed with a wall of the track, and defined along the dispenser housing, a tab portion connected to the elongated portion and arranged to engage a corresponding biased pin of the plurality of biased pins.

8. The dispenser assembly of claim 1, wherein the track includes a track offset that moves the second supply of sheet material towards the one or more openings as the carrier is moved toward the second dispensing position.

9. A dispenser assembly, comprising:

a dispenser housing supporting a plurality of supplies of sheet material and having a discharge opening defined therein through which sheet material is dispensed from the one or more of the supplies of sheet material;

at least one carrier having spindles supporting the supplies of sheet material, the carrier moveable along a track defined along the dispenser housing between a series of dispensing positions for dispensing of sheet material from each of the supplies of sheet material; and a carrier pivoting assembly connected to the at least one carrier, and including:

a lever rotatably connected to the carrier and biased into engagement with one of the supplies of sheet material such that the lever rotates during dispensing of the sheet material therefrom; and biased pins each connected to the lever and each including a body with a guidance feature configured to engage a corresponding lever guidance feature and a corresponding locking feature arranged along the track defined along the dispenser housing and which supports the at least one carrier in one of the dispensing positions, wherein the biased pins are caused to retract with rotation of the lever such that the guidance features of the biased pins disengage from the corresponding locking features to enable the at least one carrier to move along the track to another one of the dispensing positions.

10. The dispenser assembly of claim 9, wherein the one or more biased pins includes a pair of opposing biased pins connected to the lever in a spaced arrangement.

11. The dispenser assembly of claim 9, wherein the carrier pivoting assembly further comprises at least one biasing member that is connected to opposing ends of the biased pins.

12. The dispenser assembly of claim 11, wherein the guidance features of each of the biased pins comprises an angled guide surface defined along the body of the biased pin, and the corresponding guidance features of the lever comprises complementary guide surfaces defined along a portion of the lever configured to engage the one or more guide surfaces of the opposing biased pins, and wherein as the lever is rotated, the guide surfaces of the biased pins are moved along one or more corresponding guide surfaces of the lever to cause the biased pins to retract away from the locking features under the urging of the at least one biasing member.

13. The dispenser assembly of claim 9, wherein the track includes a track offset that is configured to move at least one of the supplies of sheet material towards the discharge opening when the carrier is moved along the track.

14. The dispenser assembly of claim 9, wherein the dispenser housing further comprises a pivotable cover, and wherein the track is defined within the cover of the dispenser housing.

* * * * *